US005988145A

United States Patent [19]

Horiuchi et al.

[11] Patent Number: 5,988,145

[45] Date of Patent: Nov. 23, 1999

[54] DRAIN PIPE OF CANISTER

[75] Inventors: Masaaki Horiuchi; Ryuji Fujino; Takeshi Honda, all of Saitama, Japan

[73] Assignee: Honda Giken Kogyo Kabushiki Kaisha, Tokyo, Japan

[21] Appl. No.: 09/033,677

[22] Filed: Mar. 3, 1998

[30] Foreign Application Priority Data

Mar. 4, 1997 [JP] Japan ..... 9-049323

[51] Int. Cl.[6] ..... F02M 33/04

[52] U.S. Cl. ..... 123/519

[58] Field of Search ..... 123/516, 518, 123/519, 520

[56] References Cited

U.S. PATENT DOCUMENTS

| | | | |
|---|---|---|---|
| 5,427,076 | 6/1995 | Kobayashi et al. | 123/520 |
| 5,727,530 | 3/1998 | Honda et al. | 123/520 |
| 5,855,198 | 1/1999 | Nakajima et al. | 123/520 |

*Primary Examiner*—Thomas N. Moulis
*Attorney, Agent, or Firm*—Armstrong, Westerman, Hattori, McLeland & Naughton

[57] ABSTRACT

Blockage of a drain pipe of a canister due to freezing or clogging with mud is prevented with a simple structure comprised of a small number of parts. A drain pipe, mounted to a canister body having an adsorbent accommodated therein, includes an inner shell which extends downwards from the canister body and opens at its lower end, and an outer shell which opens at its upper and lower ends. The lower end of the inner shell is inserted into the opening in the upper end of the outer shell with a gap left therebetween. Even if the opening in the lower end of the outer shell is blocked due to freezing or clogging with mud, surplus fuel or the exterior air can flow from the canister body via the opening in the upper end of the outer shell. If the opening in the lower end of the outer shell is submerged in water when evaporated fuel is purged into intake system, the drawing of water into the canister body can be prevented, because the opening in the upper end of the outer shell opens into the atmosphere.

8 Claims, 5 Drawing Sheets

DRAIN PIPE OF CANISTER

BACKGROUND

1. Field of the Invention

The present invention relates to a drain pipe of a canister having a canister body in which an adsorbent is accommodated and which is connected to a fuel tank and an intake system of an engine and communicates with the open air.

2. Related Art

A canister adapted to prevent evaporated fuel in fuel tank in an automobile vehicle from being released to the open air includes a drain pipe which permits a lower end of a canister body, having activated carbon as an adsorbent accommodated therein, to communicate with the open air. If the drain pipe is constructed from a single simple pipe, a problem occurs when the opening in the lower end of the drain pipe is blocked due to freezing or icing, clogging with mud or the like, because the exterior air cannot be introduced through the drain pipe when purging the fuel charged to the adsorbent into the intake system of the engine. Therefor, it is a conventional practice to divide the drain pipe at its intermediate portion into an upward pipe portion and a downward pipe portion through two one-way valves, so that even if the opening in the lower end of the downward drain pipe portion is blocked, the open air can be introduced through the opening in the upper end of the upward drain pipe portion.

However, the drain pipe bifurcated and provided with the two one-way valves suffers from a problem that the structure is complicated and comprised of large number of parts, resulting in an increased cost.

SUMMARY

The present invention has been accomplished with the above circumstance in view, and it is an object of the present invention to provide a drain pipe of a canister, which has a simple structure comprised of a decreased number of parts, and in which the blocking problem due to freezing or clogging with mud can be solved.

Accordingly, the drain pipe of a canister according to one embodiment comprises a canister body in which an absorbent is accommodated and which is connected to a fuel tank and an intake system of an engine and communicates with the open air, comprising an inner shell connected to the canister body, extending downwards from the canister body, and having an opening at its lower end, and an outer shell having openings at its upper and lower ends, said outer shell positioned to surround with the opening at its upper end the lower end of said inner shell with a gap left between the outer shell and the lower end of said inner shell.

According to one embodiment of the present invention, when the surplus fuel which cannot be charged to the adsorbent is discharged from the canister body via the drain pipe, or when the exterior air for purging the evaporated fuel charged to the adsorbent into the intake system is drawn through the drain pipe into the canister body, the surplus fuel or the exterior air is passed through the openings in the upper and lower ends of the outer shell. Even if the opening in the lower end of the outer shell has been blocked due to the freezing or clogging with mud, the surplus fuel or the exterior air can flow via the opening in the upper end of the outer shell. In addition, even if the opening in the lower end of the outer shell has been submerged in water, when purging the evaporated fuel into the intake system, the drawing of water into the canister body can be prevented, because the opening in the upper end of the outer shell opens into the atmosphere. Moreover, the drain pipe is of the simple structure comprised of a decreased number of parts and having no movable portion, leading to an extremely low cost.

BRIEF DESCRIPTION OF THE DRAWINGS

FIG. 1 to 4 illustrate a first embodiment of the present invention, wherein:

FIG. 1 is a perspective view of the entire arrangement of an automobile vehicle equipped with a canister;

FIG. 2 is an illustration of the arrangement of an evaporated fuel treating system including the canister;

FIG. 3 is an enlarge perspective view of a portion indicated by 3 in FIG. 1;

FIG. 4 is a sectional view taken along a line 4—4 in FIG. 3.

DETAILED DESCRIPTION

Examples of the present invention will now be described by way of embodiments shown in the accompanying figures.

Figure 1:
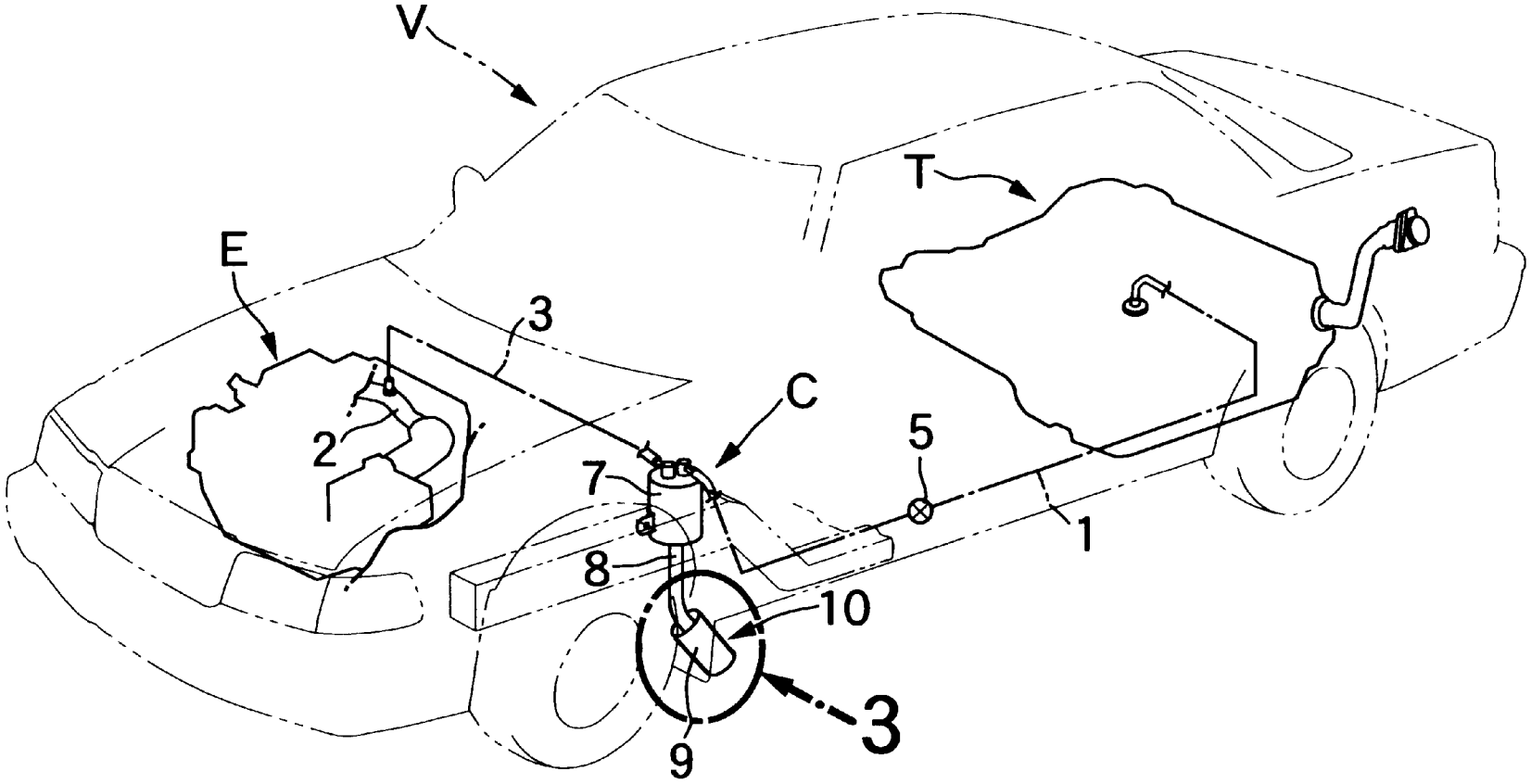
Figure 2:
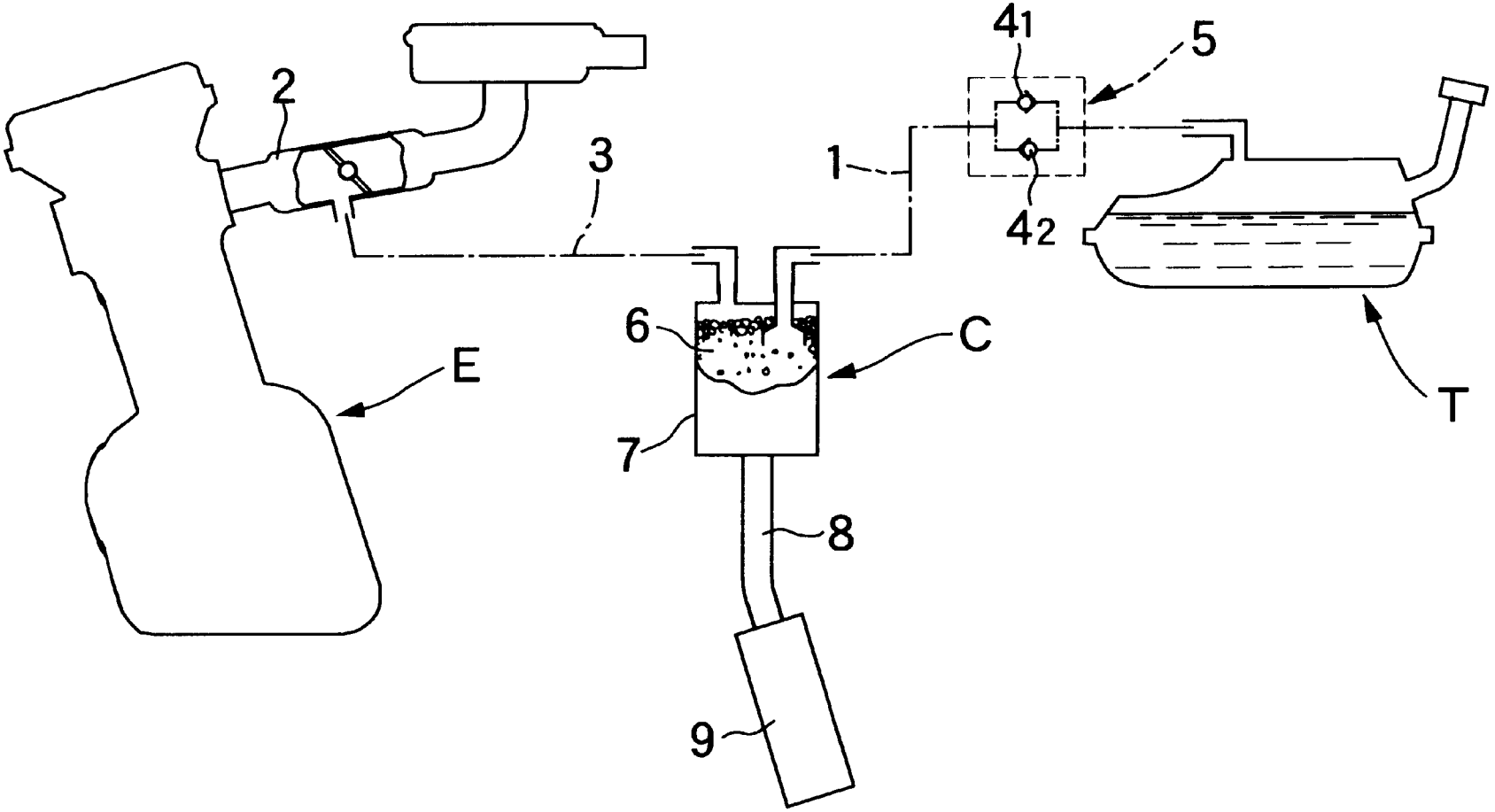

As shown in FIGS. 1 and 2, a canister C is mounted at a left rear portion of an engine room in a automobile vehicle V. The canister C is connected through a charge passage 1 to a fuel tank T mounted at a rear portion of a vehicle body, and is also connected through a purge passage 3 to an intake passage 2 in a engine E mounted in the engine room. The charge passage 1 is provided with a two-way valve arrangement 5 which is comprised of a one-way valve $\mathbf{4}_1$ adapted to permit a fuel vapor to be passed from the fuel tank T toward the canister C, and a one-way valve $\mathbf{4}_2$ which is adapted to permit the open air to be passed from the canister C toward the fuel tank T and which is connected in parallel to the one-way valve $\mathbf{4}_1$.

Figure 3:
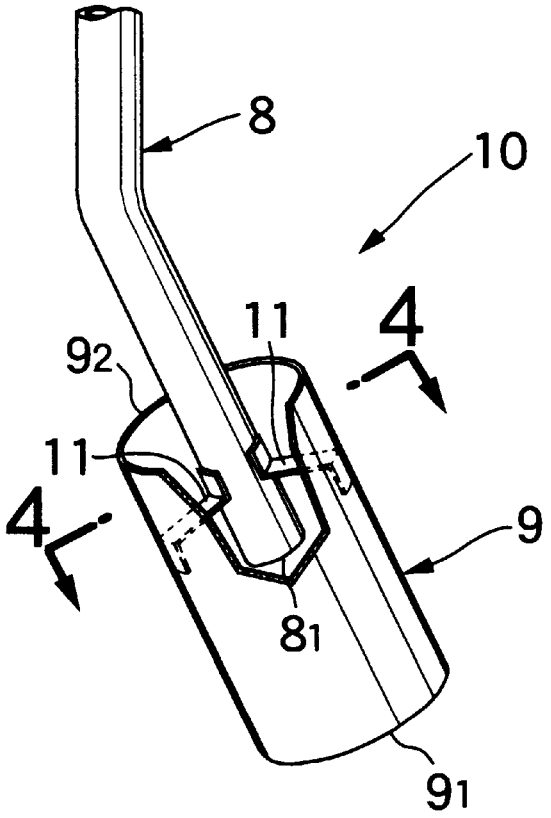
Figure 4:
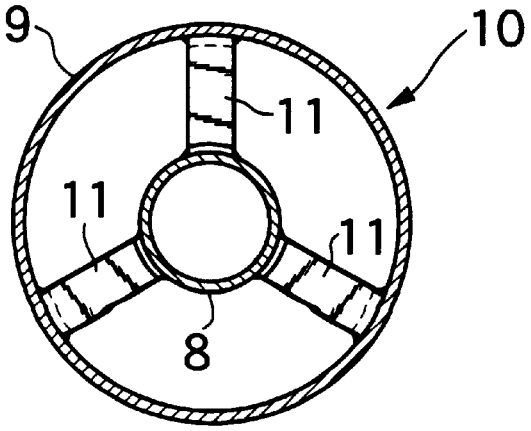

The canister C includes a canister body 7 having an adsorbent 6 accommodated therein. The adsorbent 6 is comprised of activated carbon. The charge passage 1 and the purge passage 3 are connected to an upper portion of the canister C, and a drain pipe 10 including an inner shell 8 and an outer shell 9 is connected to a lower portion of the canister C. As can be seen from both of FIGS. 3 and 4, the inner shell 8 is a pipe member connected at its upper end to a lower portion of the canister body 7, and is coupled at its lower end to the outer shell 9 by three radially disposed stays 11, with the lower end inserted into the outer shell 9. The outer shell 9 is comprised of a pipe member having a diameter larger than that of the inner shell 8. An opening $\mathbf{8}_1$ in the lower end of the inner shell 8 extends to a substantially central portion of the outer shell 9, and the outer shell 9 communicates with the exterior air at an opening $\mathbf{9}_1$ in its lower end and an opening $\mathbf{9}_2$ in its upper end.

If the internal temperature of the fuel tank T is raised by solar heat, thereby increasing the internal pressure during stoppage of the vehicle V, the one-way valve $\mathbf{4}_1$ of the two-way valve arrangement 5 mounted in the charge passage 1 is opened to permit the fuel vapor in the fuel tank T to be supplied to the canister C and charged into the adsorbent 6, thereby inhibiting the releasing of the fuel vapor into the exterior air. The amount of fuel vapor evaporated from the fuel tank T may become large and hence, if the adsorbent 6 reaches a fully charged state, the surplus fuel which cannot be charged is discharged through the drain pipe 10. At this time, even if the opening $\mathbf{9}_1$ in the lower end of the outer shell 9 has been obstructed due to freezing, clogging with mud, submergence into water or the like, the discharging of the surplus fuel is performed without hindrance, because the opening $\mathbf{9}_2$ in the upper end of the outer shell 9 communicates with the exterior air.

If the internal pressure in the fuel tank T is lowered due to a drop in the temperature, the one-way valve $\mathbf{4}_2$ of the two-way valve arrangement 5 is opened, permitting the fuel tank T to communicate with the exterior air through the canister C, thereby preventing the depression of the fuel tank T due to negative pressure. If the vehicle V starts to travel, negative pressure is developed in the intake passage 2 of the engine E. Therefore, the exterior air is drawn from the drain pipe 10 of the canister C, and the drawn air causes the evaporated fuel purged from the adsorbent 6 to be supplied via the purge passage 3 into the intake passage 2 to combust in the engine E. When the exterior air is drawn from the drain pipe 10 in the above manner, the drawing of the exterior air is performed without hindrance even if the opening $\mathbf{9}_1$ in the lower end of the outer shell 9 has been obstructed due to freezing or clogging with mud, because the opening $\mathbf{9}_2$ in the upper end of the outer shell 9 communicates with the exterior air. Additionally, even if the opening $\mathbf{9}_1$ in the lower end of the outer shell 9 has been submerged in water, water cannot be drawn into the canister C.

The drain pipe 10 is of a simple structure in which the outer shell 9 has been attached to the lower end of the inner shell 8, leading to a decreased number of parts and a reduction in cost. Moreover, the drain pipe has no movable portion, leading to a decreased probability of failure and an enhanced reliability.

Figure 5:
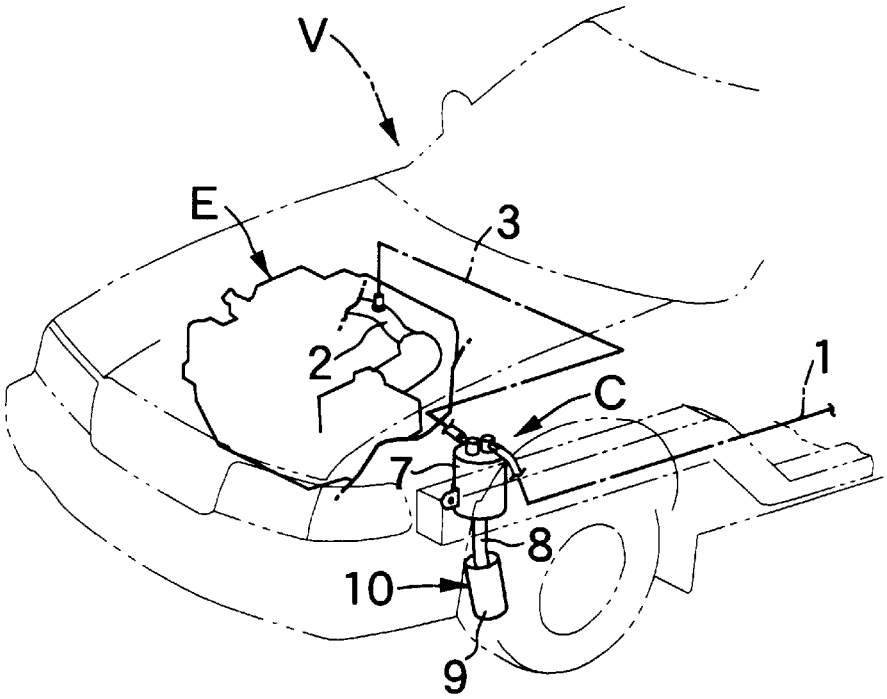
FIG. 5 is a partially perspective view of an automobile vehicle, showing a second embodiment of the present invention.
Figure 6:
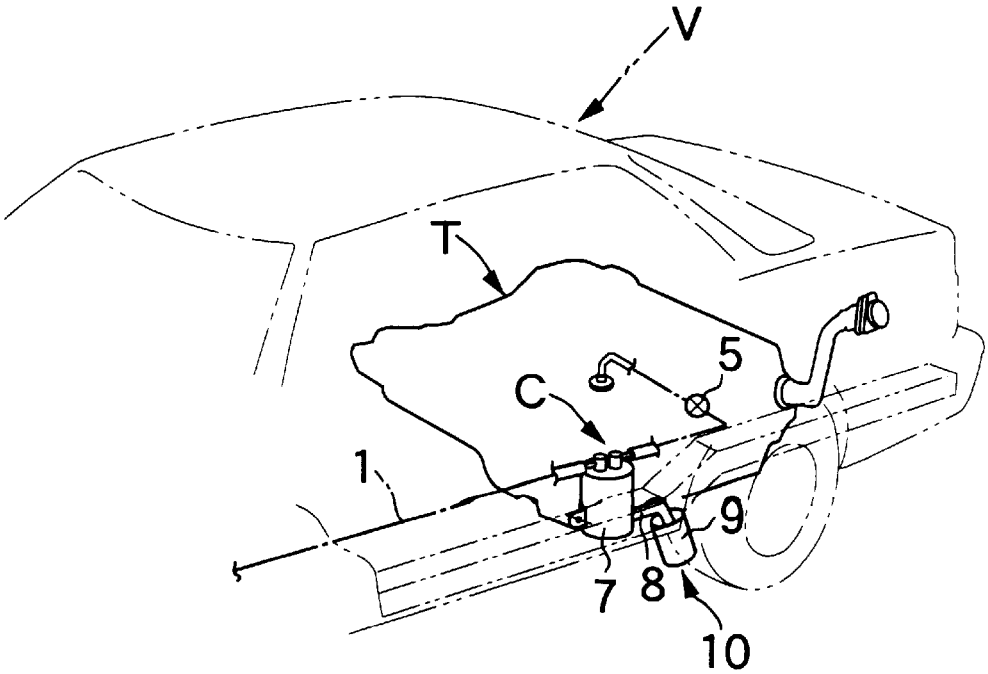
FIG. 6 is a partially perspective view of an automobile vehicle, showing a third embodiment of the present invention.
Figure 7:
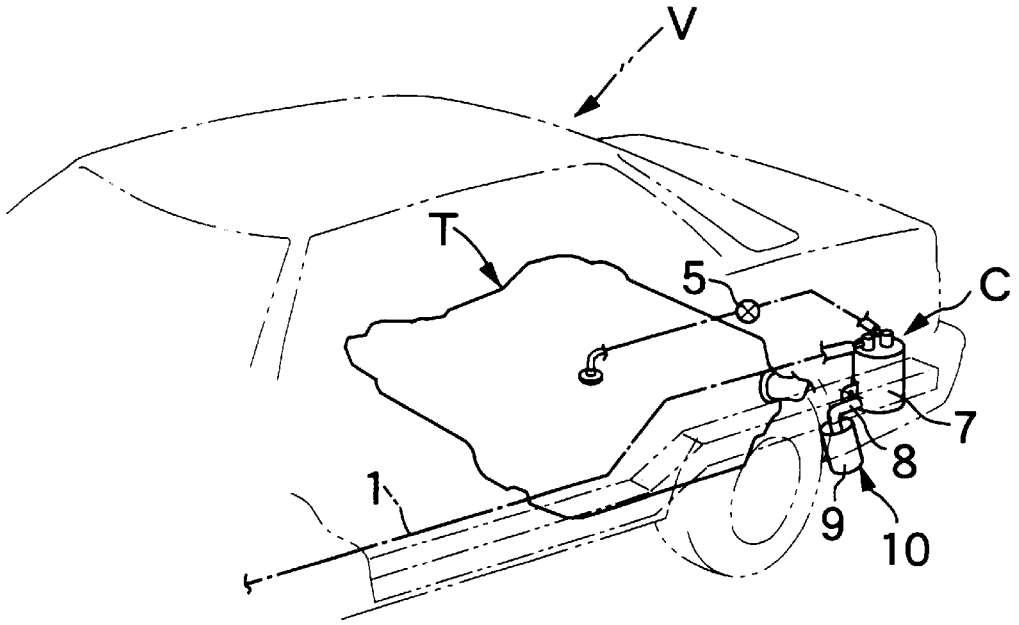
FIG. 7 is a partially perspective view of an automobile vehicle, showing a fourth embodiment of the present invention.

Although the canister C has been mounted at the rear end of the engine room in the first embodiment, it may be mounted at a front portion of the engine room, as shown in FIG. 5. Alternatively, the canister C also may be disposed below a rear seat in the vicinity of the fuel tank T, as shown in FIG. 6, or may be disposed in a trunk room, as shown in FIG. 7. In FIGS. 5, 6 and 7, the same elements as those illustrated in FIGS. 1–4 have the same labels.

Although the embodiments of the present invention has been described in detail, it will be understood that the present invention is not limited to the above-described embodiments, and various modifications in design may be made without departing from the subject matter of the present invention.

For example, the diameter of the outer shell 9 along its length is constant in the embodiment, but the diameter of a lower half of the outer shell 9 protruding from the lower end of the inner shell 8 may be smaller. The outer shell 9 need not be an independent pipe member, but an outer shell 9 may be made by coupling a gutter-shaped member to a vehicle body panel to have a closed section.

We claim:

1. A drain pipe of a canister having a canister body in which an adsorbent is accommodated and which is connected to a fuel tank and an intake system of an engine and communicates with the open air, comprising:

an inner shell connected to the canister body, extending downwards from the canister body, and having an opening at its lower end, and an outer shell having openings at upper and lower ends, said outer shell positioned to surround with the opening at its upper end the lower end of said inner shell with a gap left between the outer shell and the lower end of said inner shell.

2. The drain pipe of a canister according to claim 1, wherein said outer shell is connected to said inner shell by struts which extend radially with respect to an axis of said inner shell.

3. The drain pipe of a canister according to claim 1, wherein said inner shell and said outer shell are cylinders.

4. The drain pipe of a canister according to claim 3, wherein said inner shell and said outer shell are concentric.

5. The drain pipe of a canister according to claim 1, wherein said outer shell has a constant diameter along the entire length of the outer shell.

6. A fuel distribution system of a vehicle, comprising:

a fuel tank;

a canister;

an engine;

a fuel passage connected to said fuel tank and canister;

a fuel passage connected to said canister and said engine;

a draining element, including an inner shell having a first end connected to said canister and having a second end which opens to an exterior atmosphere, and an outer shell, positioned to surround the second end of said inner shell having first and second ends open to the exterior atmosphere.

7. The fuel distribution system of claim 6, wherein said inner shell and said outer shell are concentrically positioned cylinders.

8. The fuel distribution system of claim 7, wherein said inner shell and outer shell are connected via struts which extend radially from an exterior surface of said inner shell to an interior surface of said outer shell.

* * * * *